US007204347B2

(12) United States Patent
Schonauer et al.

(10) Patent No.: US 7,204,347 B2
(45) Date of Patent: Apr. 17, 2007

(54) ARRHYTHMIC PULSE SEQUENCE FOR SONIC DISTANCE MEASUREMENT

(75) Inventors: Uwe Schonauer, Berlin (DE); Peter L. Herkel, Berlin (DE)

(73) Assignee: Otis Elevator Company, Farmington, CT (US)

( * ) Notice: Subject to any disclaimer, the term of this patent is extended or adjusted under 35 U.S.C. 154(b) by 538 days.

(21) Appl. No.: 10/490,071

(22) PCT Filed: Oct. 15, 2002

(86) PCT No.: PCT/US02/32907

§ 371 (c)(1),
(2), (4) Date: Mar. 17, 2004

(87) PCT Pub. No.: WO03/043920

PCT Pub. Date: May 30, 2003

(65) Prior Publication Data

US 2004/0195048 A1 Oct. 7, 2004

(30) Foreign Application Priority Data

Nov. 15, 2001 (DE) ..... 101 56 043

(51) Int. Cl.
*B66B 1/34* (2006.01)

(52) U.S. Cl. ..... 187/394; 367/124

(58) Field of Classification Search ..... 187/391–394; 367/120, 127, 124; 324/207.11, 207.12, 324/207.15, 207.16, 207.17
See application file for complete search history.

(56) References Cited

U.S. PATENT DOCUMENTS 5,223,680 A 6/1993 Schmidt-Milkau et al.
5,306,882 A * 4/1994 Gerwing et al. ..... 187/394
5,736,695 A * 4/1998 Hoepken ..... 187/394
5,883,345 A * 3/1999 Schonauer et al. ..... 187/394
6,311,803 B1 * 11/2001 Turk ..... 187/394
6,366,532 B1 * 4/2002 Hoepken ..... 367/127
6,554,107 B2 * 4/2003 Yumura et al. ..... 187/247
6,570,817 B2 * 5/2003 Hoepken ..... 367/124
6,659,232 B2 * 12/2003 Oelschlegel ..... 187/394

FOREIGN PATENT DOCUMENTS

EP 1030189 A1 1/2000

* cited by examiner

*Primary Examiner*—Jonathan Salata

(57) ABSTRACT

A position detecting device for detecting the position of an object (12) movable along a predetermined path of movement, comprising a signal transmission medium (13) extending along the path of movement, a signal generator (15) movable together with said movable object (12), by means of which a signal can be coupled into the signal transmission medium (13), at least one signal receiver (29, 33) at an extraction location in an end portion of said path of movement, a signal propagation time measuring means (35, 37) adapted to determine the signal propagation time between coupling location and extraction location (45), wherein the signal generator (15) is designed to deliver a periodically repeating signal pulse sequence (FIG. 2) in which the time intervals between consecutive signal pulses are different for each pair of consecutive signal pulses each, the period duration of the repetitive signal pulse sequence is greater than the maximum signal propagation time with maximum interval between coupling location and extraction location, and the time intervals between consecutive signal pulses are shorter than the maximum signal propagation time.

12 Claims, 3 Drawing Sheets

ARRHYTHMIC PULSE SEQUENCE FOR SONIC DISTANCE MEASUREMENT

TECHNICAL FIELD

The invention relates to a position detecting device for detecting the position of an object movable along a predetermined path of movement, in particular an elevator car of a motor-driven elevator, comprising a signal transmission medium extending along the path of movement, a signal generator movable together with said movable object, by means of which a signal can be coupled into the signal transmission medium at a coupling location thereof changing in accordance with the movement of said signal generator, at least one signal receiver at an extraction location at an end point of said path of movement, by means of which the signal can be extracted from the signal transmission medium, a signal propagation time measuring means adapted to determine the signal propagation time between coupling location and extraction location by evaluating the signal extracted at the ex-traction location, and a processing means adapted to derive from the signal propagation time ascertained a position signal indicating the instantaneous position of the object along the path of movement.

BACKGROUND ART

The documents EPO694 792 A1 and the corresponding U.S. Pat. No. 5,736,695 A reveal such a device using ultrasonic energy. A sound signal generator at the elevator car couples sound pulses into a sound conductor, for example in the form of a metal wire. A receiver at the upper or lower end of the elevator path receives the sound pulses. On the basis of the known speed of sound in the sound conductor and the sound traveling or propagation time of the pulses measured, it is possible to calculate the distance between signal generator and receiver and thus the position of the elevator car in the elevator path.

To be able to measure the sound propagation time, the measuring means must be capable of unequivocally associating a sound pulse received at the end of the elevator path with a specific transmitted pulse. In case of this known device, this is ensured in that the time interval between two pulses transmitted is greater than the sound propagation time from one end to the other end of the sound conductor. Thus, there can always be only one sound pulse on the sound conductor at a time, and this sound pulse has to belong to the pulse transmitted last.

It is disadvantageous in this respect that a lower measurement value actualization rate results with longer elevator traveling distances. This renders the measurement slow and sensitive to occasional interference and white noise, for example, quantization errors in the signal processing operation.

That the transmission of sound pulses at spaced time intervals greater than the sound propagation time between the two ends of the sound conductor causes problems in elevators with long travel path, can be seen, for example, from the elevator installed in the Munich Olympic Tower, which has a travel path of approx. 200 meters and moves at a speed of 7 m/s. Assuming a sound propagation time of 20 ms per 100 m length of a metal wire, a sound propagation time of 40 ms between lower end and upper end of the travel path results for the approx. 200 m long travel path of the elevator of the Olympic Tower. With a time interval between the sound pulses coupled successively into the metal conductor which is greater than the sound propagation time between both ends thereof, consecutive sound pulses would have to have a time interval of more than 40 ms. With a running speed of 7 m/s, the elevator car would move on 28 cm between the transmission of two consecutive sound pulses. For modern elevator systems in which the elevator car is to be controlled with an accuracy of 1 mm, a detection of the elevator car position every 28 cm along the travel path only, is completely insufficient.

It is known from DE 199 03 645 A1 and the corresponding CA 2296472 A1 to transmit measurement pulses having the same time interval from each other that is shorter than the sound propagation time in the sound conductor from one end to the other end of the elevator path in order to obtain a higher actualization rate. This has the result that there is always a plurality of sound pulses on the metal wire serving as sound conductor at the same time. In order to be able to assign each of these measurement pulses to a specific transmitted measurement pulse on the receiving side, synchronization pulses are transmitted in addition to these measurement pulses, with the distances in time between the same being greater than the maximum propagation time of a sound pulse from one end to the other end of the sound conductor and with these synchronization pulses being different from the measurement pulses by a predetermined feature. For example, each synchronization pulse has a time interval from the measurement pulses adjacent the same, which is different from the time interval between adjacent measurement pulses. For example, the respective synchronization pulse is in the middle of the time interval between two adjacent measurement pulses. Thus, a measurement pulse received can be associated unequivocally with the synchronization pulse transmitted last. The measurement pulses between two consecutive synchronization pulses may then be associated on the receiver side with a specific measurement pulse transmitted by way of their identification number in relation to the respective synchronization pulse.

This method is not without disadvantages, either. On the one hand, an association of a receiving pulse with a specific transmission pulse is possible only after arrival of the corresponding synchronization pulse. On the other hand, this method is sensitive to disturbances due to reflected pulses, especially with regard to the fact that the received pulses usually do not have ideal pulse edges, but impaired pulse edges. Reflections are caused, for example, in that the sound conductor indeed is terminated at both ends thereof by attenuation members, but these do not completely absorb the sound pulses, but reflect the same in part. Such reflections have the result that pulses not belonging to the same transmission pulse meet at specific locations along the sound conductor. If disturbing interference arises between transmission pulses and reflection pulses at a specific location along the sound conductor, this interference holds for all measurement pulses, due to the same time interval between the measurement pulses.

The hardware and software requirements for the evaluation algorithm are determined by the smallest time interval between two adjacent pulses. The shorter this interval, the higher the processing clock rate needs to be and the higher the requirements for hardware and software and thus for the costs for the same. Due to the fact that, in the known method, the respective synchronization pulse is placed between the two measurement pulses adjacent the same, hardware and software have to be designed for a processing rate corresponding to the brief distances or intervals in time between a synchronization pulse and the measurement pulses adjacent the same. Hardware and software thus need to be of more complex design than required for processing of the measurement pulses alone. I.e., for processing the measurement pulses proper, it would be sufficient to have hardware and software that could be much less complex if there were no synchronization pulses.

SUMMARY OF THE INVENTION

It is the object underlying the invention to overcome the aforementioned problems of known solutions, in particular to make available a position detecting device in which, with a pulse distance between adjacent measurement pulses that is shorter than the signal propagation time between the two ends of the signal transmission medium, the receiving pulses can be associated unequivocally with the transmission pulses, without synchronization pulses being required in addition.

This object is met by a position detecting device according to the invention, as indicated in claim 1. Embodiments of the position detecting device according to the invention are indicated in the dependent claims.

The invention provides a position detecting device for detecting the position of an object movable along a predetermined path of movement, comprising a signal transmission medium extending along the path of movement, a signal generator movable together with said movable object, by means of which a signal can be coupled into the signal transmission medium at a coupling location thereof changing in accordance with the movement of said signal generator, at least one signal receiver at an extraction location at an end point of said path of movement, by means of which the signal can be extracted from the signal transmission medium, a signal propagation time measuring means adapted to determine the signal propagation time between coupling location and extraction location by evaluating the signal extracted at the extraction location, and a processing means adapted to derive from the signal propagation time ascertained a position signal indicating the instantaneous position of the object along the path of movement. The position detecting device according to the invention distinguishes itself in that the signal generator thereof delivers a periodically repeating signal pulse sequence in which the time intervals between consecutive signal pulses are different for each pair of consecutive signal pulses each, that the period duration of the repetitive signal pulse sequence is greater than the maximum signal propagation time with maximum distance between coupling location and extraction location, and in that the time intervals between consecutive signal pulses are shorter than the maximum signal propagation time.

The present invention makes use of a periodically repeating arrhythmic pulse sequence for being able to unequivocally associate the receiving signals, which successively arrive at the signal receiver, with the respectively associated transmission pulses of the signal generator. Due to the fact that the period duration, i.e. the time interval between the periodically repeating pulse sequences, is greater than the maximum signal propagation time occurring with maximum distance between coupling location and extraction location, there are, at a particular moment of time, always only such pulses in the signal transmission medium that belong to the same pulse sequence. Due to the fact that a predetermined time interval from the preceding pulse is associated exclusively with one specific pulse of the respective pulse sequence, each receiving pulse occurring at the signal receiver can be associated unequivocally with one specific transmission pulse transmitted by the signal generator.

With an arrhythmic pulse sequence according to the invention, the minimum time interval between respective adjacent pulses may remain in an order of magnitude that is considerably greater than the time interval present in the synchronization pulses of the position detecting device according to DE 199 03 645 A1 with respect to the measurement pulses adjacent the same.

Thus, the position detecting device according to the invention can make do with hardware and software that are less complex than required in case of DE 19903645 A1.

In an embodiment of the invention, the sequence of the different time intervals between each pair of consecutive pulses each of a pulse sequence is selected such that the time intervals between non-adjacent pulses of the pulse sequence, e.g. between first and third, second and fifth, third and sixth pulses of the pulse sequence or first and fifth, second and sixth, third and seventh, etc., pulses of a pulse sequence for each particular pair of non-adjacent pulses of the pulse sequence are different as well. The advantageous result hereof is that, even if part of the pulses of a pulse sequence fails to be usable for position detection due to disturbances, the remaining pulses on the receiving side still can be associated unequivocally with the respectively related transmission pulses. Thus, in this case, too, secure calculation of the signal propagation time between the instantaneous position of the signal generator and the position of the signal receiver can be ensured.

In an embodiment of the invention, the signal is constituted by a sound signal, in particular an ultrasonic signal, the signal transmission medium is constituted by a sound conductor, in particular a metal rail, a metal rope or a metal wire, the signal generator is constituted by a sound signal generator, the signal receiver is constituted by a sound signal receiver, and the signal propagation time measuring means is constituted by a sound propagation time measuring means. However, for the purpose according to the invention, there may also be used other signal transmission media, for example optical waveguides, electric waveguides or air clearances via which sound pulses, light pulses or radio-frequency pulses can be transferred.

In an embodiment of the invention, there is provided one single signal receiver at an end of the path of movement, with the respective instantaneous position of the movable object being determined on the basis of the signal propagation time between signal generator and receiver as being the distance between the movable object from that end of the path of movement where the sole signal receiver is located.

In another embodiment of the invention, there is provided one signal receiver each at each end of the path of movement, and the signal propagation time is ascertained from the instantaneous position of the movable object both with respect to the one end and the other end of the path of movement. In this manner, it is not only possible to determine the instantaneous position of the movable object, but also the overall length of the path of movement between the two signal receivers. When the overall length determined at a particular moment of time is compared with the overall length determined at an earlier time, one can see whether changes in the path of movement have occurred in the meantime, for example changes due to temperature fluctuations. This provides for the possibility of not only recognizing but also compensating e.g. such changes due to temperature fluctuations, for example, with respect to a stored reference value of the movement path length.

In an embodiment of the invention, the receiving signals received at the two signal receivers are fed to a common processing means, as is known per se from EP 0 694 792 A1, and in said processing means there is formed the difference between the moments of time at which the receiving signals are delivered by the two signal receivers. From this difference in time, the instantaneous position of the movable object can be concluded. A time difference of zero between the two receiving signals means that the movable object is exactly in the middle between the positions of the two signal receivers. In case of a time difference other than zero, the movable object is located between the middle of the path of movement and the one or the other signal receiver, depending on the sign of the difference in time.

In another embodiment of the invention, each of the signal receivers has a signal propagation time measuring means associated therewith through which the signal propagation time of the receiving signal arriving at one of the two signal receivers is determined independently of that of the receiving signal arriving at the other signal receiver. To this end, each of the two signal propagation time measuring means, in addition to the receiving signal delivered by the respectively associated signal receiver, is directly fed with the transmission signal of the signal generator. Each signal propagation time measuring means, by way of a comparison of the two signals delivered thereto, thus can determine the signal propagation time via the signal transmission medium from the instantaneous position of the signal generator to the position of the associated signal receiver.

DETAILED DESCRIPTION OF THE INVENTION

Figure 1:
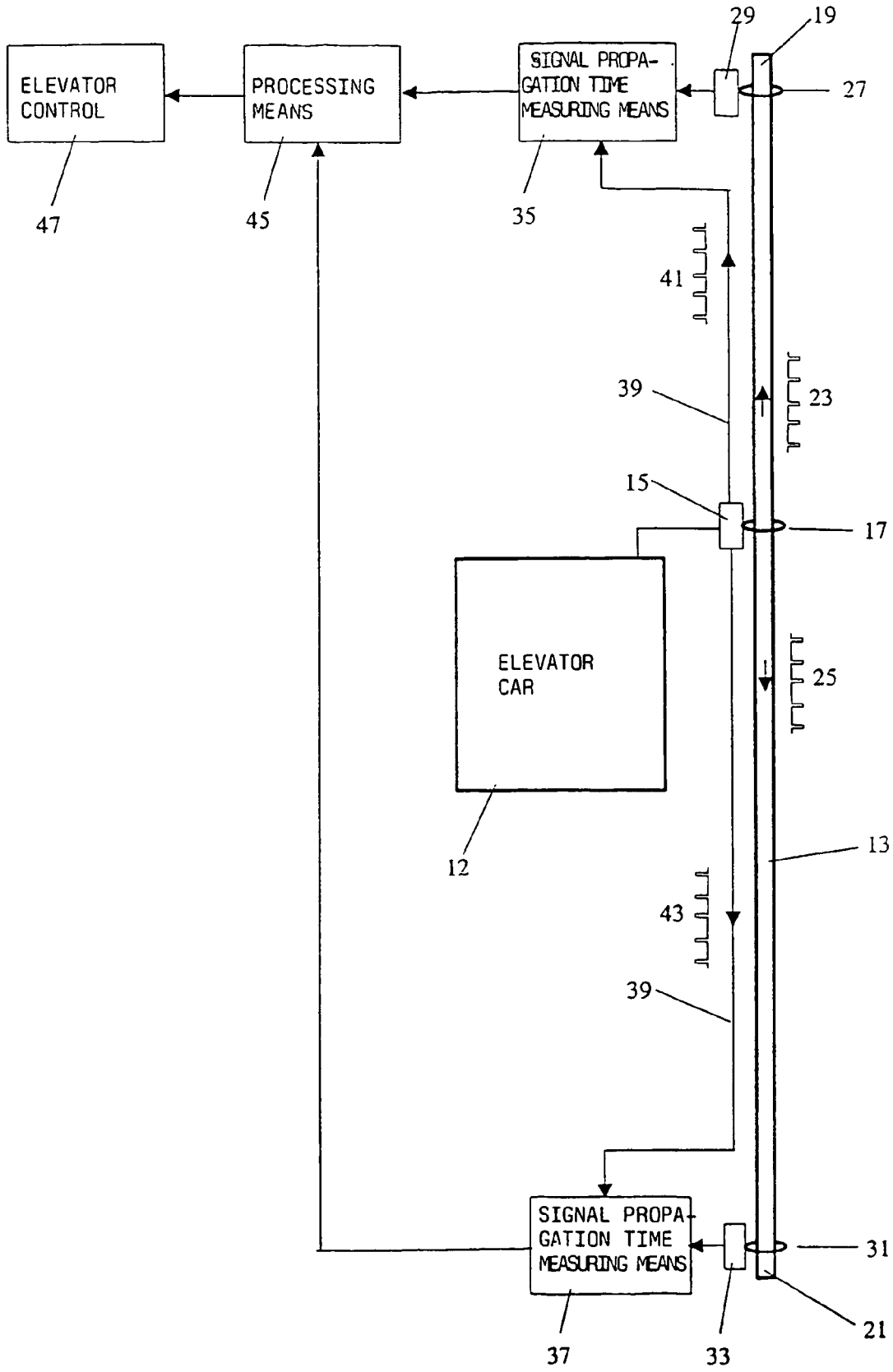
FIG. 1 shows an embodiment of an elevator system comprising a position detecting device according to the invention.

The embodiment of the invention illustrated hereinafter and shown in FIG. 1 relates to a position detecting device for an elevator system, namely for detecting the position of an elevator car 12 movable along an elevator path. Extending along this elevator path, which is located in an elevator hoistway, not shown, is a signal transmission medium in the form of a sound conductor 13 which preferably is a metal rail, a metal rope or a metal wire. However, sound conductors of other materials than metal are suitable as well, such as e.g. sound conductors of hard plastics material. The sound conductor 13 extends from a lower end to an upper end of the elevator hoistway.

Arranged on the elevator car 12 is a signal generator 15 movable together with the elevator car 12 and comprising a signal generating means for generating electric transmission pulses on the side of the signal generator as well as a signal transducer on the side of the signal generator for converting the electric transmission pulses into sound pulses. This signal transducer feeds a signal coupler 17 movable along the sound conductor 13 and adapted to couple the sound pulses into the sound conductor 13. From the particular location of the signal coupler 17, the sound pulses travel, at the speed of sound inherent to sound conductor 13, both to an upper end 19 and to a lower end 21 of sound conductor 13, which is illustrated in FIG. 1 by upwardly traveling sound pulses 23 and downwardly traveling sound pulses 25.

In the region of the upper end 19 of sound conductor 13, there is provided an upper signal extractor 27 which feeds the sound signals 23 coupled out or extracted by the same to an upper signal receiver 29 by means of which the extracted sound pulses 23 are converted into electric receiving pulses. In the region of the lower end 21 of sound conductor 13, there is provided a lower signal extractor 31 by means of which the downwardly traveling sound pulses 25 are extracted from the sound conductor 13. The lower signal extractor 31 feeds a lower signal receiver 22 by means of which the sound pulses extracted from sound conductor 13 are converted into electric receiving pulses. The two signal extractors 27 and 31 are mounted in stationary fashion, i.e. so as to be immovable relative to sound conductor 13.

The upper signal receiver 29 and the lower signal receiver 33 supply their receiving pulses to an upper signal propagation time measuring means 35 and a lower signal propagation time measuring means 37, respectively. The two signal propagation time measuring means 35 and 37 are each connected via an electric line 39 to the signal generating means of signal generator 15. The latter feeds the electric transmission pulses generated by the signal generating means into the electric lines 39, with these pulses being passed from the feeding location thereof to the signal propagation time measuring means 35 and 37 via the electric lines 39, which is illustrated in FIG. 1 by way of electric transmission pulses 41 directed towards the upper signal propagation time measuring means 35 and electric pulses 43 directed towards the lower signal propagation time measuring means 37.

Due to the fact that signal generator 15 moves relative to electric line 39 during movement of the elevator car 12 along the elevator hoistway, the feeding location is moved along with the elevator car. To this end, an embodiment of the invention, in a manner known per se, makes use of suspended ropes suspended to the elevator car 12 from a suspension location in the region of the upper hoistway end.

The upper signal propagation time measuring means 35 determines the sound propagation time of the upwardly traveling sound pulses 23 from signal coupler or injector 17 to the upper signal extractor 27 by way of a comparison of the electric receiving signals delivered by the upper signal receiver 29 and the upwardly directed electric transmission pulses 41 delivered by the signal generating means. The lower signal propagation time measuring means 37 determines the sound propagation time of the downwardly traveling sound pulses 25 from the respective position of sound coupler 17 to the position of the lower signal extractor 31, by comparing the moments of time of the arrival of the electric receiving pulses delivered by lower signal receiver 33 with the moment of time of arrival of the electric transmission pulses 43 directed downwardly from the signal generator 15. The time interval present between the electric receiving pulses delivered by signal receivers 29 and 33 and the electric transmission pulses 41 and 43, respectively, is a measure of the sound propagation time of the sound pulses 23 and 25, respectively, from the respective position of the signal generator 15 to the upper signal extractor 27 and the lower signal extractor 31, respectively.

The signal propagation times ascertained by the two signal propagation time measuring means 35 and 37 are supplied to a processing means 45 by means of which the instantaneous position of the signal generator 15 and thus the instantaneous position of the elevator car 12 are detected. On the basis of the signal propagation time delivered by the signal propagation time measuring means 35, the processing means 45 determines the instantaneous distance of the elevator car 12 from the upper signal extractor 27, and on the basis of the signal propagation time delivered by the lower signal propagation time measuring means 37, the processing means 45 calculates the instantaneous distance of the elevator car 12 from the lower signal extractor 31. The instantaneous position of the elevator car 12 determined by the processing means 45 is transferred to an elevator control 47 which controls in particular moving and stopping of the elevator car 12 as well as opening of elevator doors (not shown).

Due to the fact that the instantaneous distance of the sound coupler 17 from the upper signal extractor 27 as well as the instantaneous distance of the sound coupler 17 from the lower signal extractor 31 are determined independently of each other with the aid of the two signal propagation time measuring means 35 and 37, the processing means 45 is capable of calculating also the overall distance between the two signal extractors 27 and 31. By storing the overall distance between the two signal extractors 27 and 31, which were determined at a particular time, and by comparison of subsequently determined values of this overall distance with the value stored, it is possible to detect changes, e.g. variations due to temperature fluctuations, which provides for the aforementioned possibility of compensating temperature effects on the respective elevator car position determined.

Due to the fact that the two distances between instantaneous position of the sound coupler 17 and the positions of the sound extractors 29 and 31 are determined independently of each other, there is also provided redundancy which leads to enhanced security against disturbances and failure. In case of failure of the signal propagation time measurement either of the upwardly traveling sound pulses 23 or of the downwardly traveling sound pulses 25, the remaining signal propagation time measurement is still capable of determining the instantaneous position of the elevator car 12 as being the distance from the signal extractor 27 or 31, respectively, whose extraction signals can still be evaluated.

In the following, it will be illustrated by way of FIG. 2 how the invention ensures the unequivocal association of each receiving pulse arriving at the signal receiver 29 and 33, respectively, with the respectively related transmission pulse on the signal generator side, although the time intervals between consecutive time pulses of the pulse sequence are shorter than the signal propagation time between the two signal extractors 29 and 31.

Figure 2:
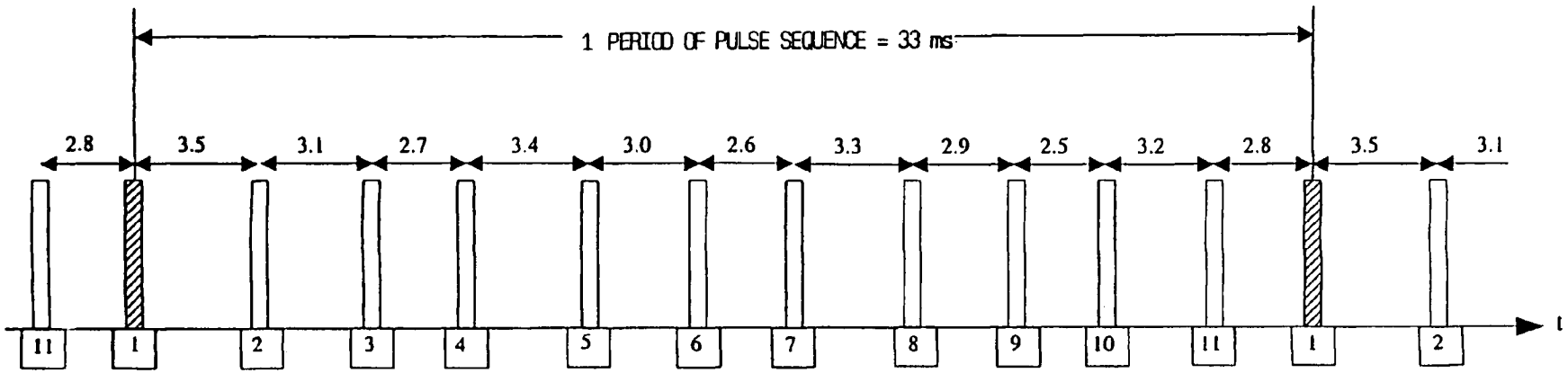
FIG. 2 shows an embodiment of an arrhythmic pulse sequence according to the invention.

FIG. 2 illustrates, by way of an embodiment of the invention, a pulse sequence with 11 pulses having identification numbers 1 to 11, with said pulse sequence being repetitive with a period duration of 33 ms. A pulse sequence of such period duration is designed, for example, for an elevator system having a length of the movement path of the elevator car 12 of 130 m. With an assumed sound propagation time of 20 ms for each 100 m in the metallic sound conductor 13, a pulse sequence with a period duration of 33 ms would be suitable for movement path lengths of up to 160 m.

FIG. 2 shows the time intervals or interval lengths between two adjacent pulses each in ms. According to the invention, the time intervals between successive signal pulses are different for each pair of successive signal pulses of the pulse sequence each. In case of the pulse sequence illustrated in FIG. 2, there is no interval length between adjacent pulses occurring twice. Therefore, each of the eleven pulses of a pulse sequence is defined unequivocally by its time interval with respect to the particular preceding pulse.

As the period duration of the periodically repeating signal pulse sequence is chosen such that it is greater than the maximum sound propagation time occurring between the two signal extractors 27 and 31, the sound conductor 13 at all times can carry only such sound pulses that belong to the same pulse sequence. Thus, there can never be two pulses on sound conductor 13 that have the same time interval as their respective preceding pulse.

Figure 3:
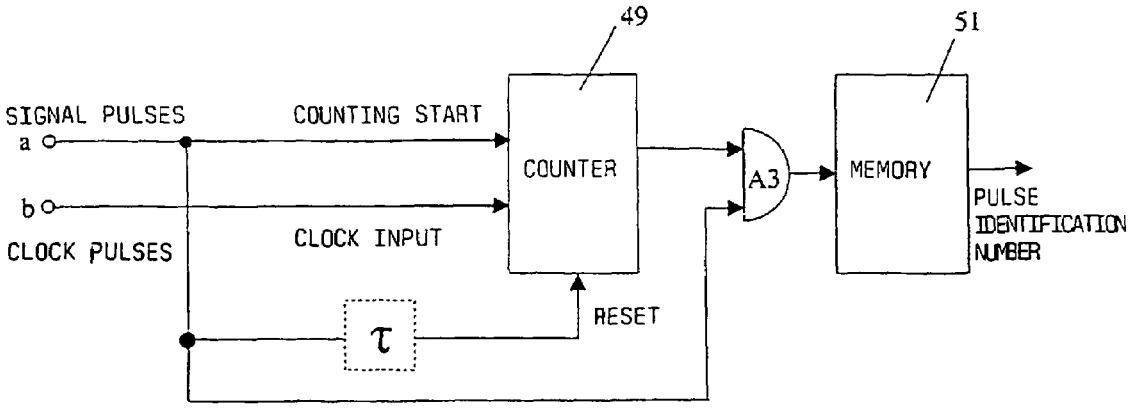
FIG. 3 shows block diagram of an apparatus for detecting a pulse identification number.

The two signal propagation time measuring means 35 and 37 are each provided with a means for determining the pulse identification number of the respective receiving pulse, by ascertaining the time interval between the just arrived receiving pulse and a receiving pulse ahead of the same in terms of time. To this end, each of the two signal propagation time measuring means 35 and 37 may be provided with a pulse identification number determining means having the structure shown in FIG. 3. This pulse identification number determining means comprises a counter 49, a memory 51 having at least one electronic table stored therein, and an AND circuit A3 and possibly a delay member $\tau$ in the wiring arrangement as shown in FIG. 3. Counter 49 has a first input, designated counting start, a second input designated clock input as well as a reset input. Applied to the counting start input are the electric signal pulses delivered by signal receiver 29 and 31, respectively. The clock input is connected to a clock generator the clock pulses of which are counted by counter 49. Counter 49 has furthermore an output from which the respective count reached is available AND circuit A3 is fed with the count of counter 49 via a first input and with the signal pulses via a second input. The output signal of AND circuit A3 is fed to memory 51 as input signal. The pulse identification number of the receiving pulses that arrived last is available at an output of memory 51.

FIG. 4*a* illustrates two pulses of the pulse sequence shown in FIG. 2 and FIG. 4*b* illustrates clock pulses.

The mode of operation of the circuit arrangement illustrated in FIG. 3 will be described in the following.

Figure 4:
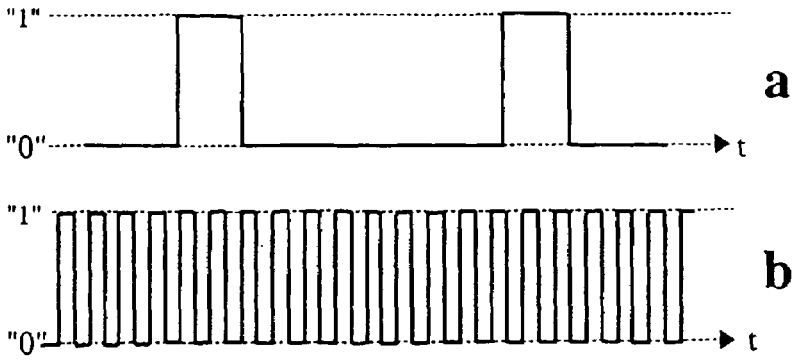
FIG. 4 shows two pulses of a pulse sequence (a) according to the invention and a clock pulse sequence (b).

The counting of clock pulses by counter 49 is started by a descending edge of the pulse sequence. As of this, the signal of the pulse sequence has a logic value "0", so that AND circuit A3 is blocked. Along with the transition to logic value "1" as of the beginning of the next pulse of the pulse sequence, AND circuit A3 is opened, and the same transfers the current counting value of counter 49 reached at that time to memory 51. This transition to logic value "1" also triggers resetting of the counter. This resetting takes place with a delay in time with respect to the transfer of the current counting value from the counter output to memory 51. The sequence in time thus is such that the counting value of counter 49 reached at the beginning of the second pulse shown in FIG. 4 is applied, via AND circuit A3, to the input of memory 51, and the counter 49 is then reset before it can count the next clock pulse. As of resetting of counter 49, the same is ready for a new counting operation beginning with the descending edge of the second pulse in FIG. 4*a*.

Utilizing conventional circuit components, the inherent delay thereof will be sufficient in general. Otherwise, the delay member" shown in broken lines in FIG. 3 can be added.

In an embodiment of the invention, running time measurement makes use of a microcontroller which in terms of software is programmed so as to control the sequence in time mentioned, namely first reading out of the counting value and then resetting of counter 49. The AND circuit A3 and the delay member τ are not necessary in this event.

Stored in memory 51 is an electronic table associating the corresponding pulse identification number with each of the interval values of the pulse sequence in FIG. 2 and thus unequivocally identifying the receiving pulse received last in the particular pulse sequence. It is thus possible to unequivocally associate the respectively related receiving pulse with any of the electric pulses 41 and 43 received in the signal propagation time measuring means 35 and 37, respectively, and measure the correct propagation time of the respective receiving pulse.

A pulse identification number determination for the electric transmission pulses 41 and 43 in the signal propagation time measuring means 35 and 37 can be carried out with circuits corresponding to FIG. 3.

If, in accordance with the already mentioned embodiment of the invention, the sequence of the different time intervals between the successive pulses of a pulse sequence is selected such that the time intervals between non-adjacent pulse pairs of the pulse sequence are different as well for each particular pulse pair, it is not only possible to ensure correct association of the respective receiving pulse with the related transmission pulse if all pulses of the respective pulse sequence arrive at signal receiver 29 and 33, respectively, but to ensure the same also if only part of the pulses of a pulse sequence arrives at the respective signal receiver 29 and 33, respectively. This can be demonstrated by way of the table below illustrating, by way of example, the time intervals between respectively adjacent pulses of a pulse sequence with gaps, for one pulse each missing, for 3 pulses each missing, for 5 pulses each missing and for 8 pulses each missing between two pulses adjacent a pulse gap in a pulse sequence with gaps.

TABLE

| Time intervals between respective adjacent pulses in case of pulse sequences with gaps: | |
|---|---|
| Time interval between pulses | |
| One pulse each missing: | |
| 1 and 3 | 6.6 ms |
| 2 and 4 | 5.8 ms |
| 3 and 5 | 6.1 ms |
| 4 and 6 | 6.4 ms |
| 5 and 7 | 5.6 ms |
| 6 and 8 | 5.9 ms |
| 7 and 9 | 6.2 ms |
| 8 and 10 | 5.4 ms |
| 9 and 12 | 5.7 ms |
| 10 and 1 | 6.0 ms |
| Three pulses each missing: | |
| 1 and 5 | 12.7 ms |
| 2 and 6 | 12.2 ms |
| 3 and 7 | 11.7 ms |
| 4 and 8 | 12.3 ms |
| 5 and 9 | 11.8 ms |
| 6 and 10 | 11.3 ms |
| 7 and 12 | 11.9 ms |
| 8 and 1 | 11.4 ms |
| Five pulses each missing | |
| 1 and 7 | 18.3 ms |
| 2 and 8 | 18.1 ms |
| 3 and 9 | 17.9 ms |
| 4 and 10 | 17.7 ms |
| 5 and 12 | 17.5 ms |
| 6 and 1 | 17.3 ms |

TABLE-continued

| Time intervals between respective adjacent pulses in case of pulse sequences with gaps: | |
|---|---|
| Time interval between pulses | |
| Eight pulses each missing: | |
| 1 and 10 | 27 ms |
| 2 and 11 | 26.7 ms |
| 3 and 1 | 26.8 ms |

This table reveals that the time intervals between adjacent pulses, between which pulses are missing, are different for each pulse location. Even if only part of the pulse sequence arrives at the respective signal receiver 29 and 33, respectively, it is possible to determine unequivocally, from the length of the pulse gap between two successive pulses of this pulse sequence with gaps, which pulse with which pulse identification number of the pulse sequence is concerned by the receiving pulse just received.

For rendering possible an unequivocal association of a receiving pulse of a pulse sequence received with gaps only, the embodiment of a pulse identification number determining means shown in FIG. 3 does not only involve storing of all pulse intervals between the individual pulses of a complete pulse sequence in the electronic table of memory 51, but also of all intervals for a pulse sequence received with gaps in which only one pulse is missing, all intervals for a pulse sequence received with gaps in which two pulses are missing, all intervals for a pulse sequence received with gaps in which three pulses are missing, etc. This is carried out for all possible pulse gaps each along the pulse sequence.

If electronic memory 51 receives a counting value from AND circuit A3, this counting value is compared to all intervals stored in the electronic table of memory 51. If, e.g. a pulse interval of 3.3 ms corresponds to the counting value, this has to be the pulse No.8 of a pulse sequence without gaps. If the counting value corresponds e.g. to a pulse interval of 11.8 ms, the ninth pulse of a sequence with gaps has to be involved in which pulses No.6, 7 and 8 are missing. If a pulse interval of e.g. 26.7 ms corresponds to the counting value, the eleventh pulse of a pulse sequence with gaps has to be involved in which pulses 3 to 10 are missing.

By using a pulse sequence according to the invention, it is thus ensured without the requirement of additional synchronization pulses that the respective receiving pulse at all times can be associated with the related transmission pulse, even if only a small part of the pulses of a pulse sequence arrives at the signal receiver 29 and 33, respectively.

There are various factors of influence to the effect that the pulse edges are more or less flattened. For this reasons, certain tolerances have to be considered in measuring the time intervals between successive pulses. To ensure sufficient security of synchronization between received pulses and the related transmission pulses, a tolerance limit is advantageously set for the pulse interval measurement. In the example illustrated in FIG. 2, it is fixed e.g. that the deviation from the defined time interval between two particular pulses of the pulse sequence must not be exceeded or fallen short of by more than 10 μs in order to be still valid for the identification of a specific defined interval.

The use of different interval lengths provides for the possibility of determining faulty behavior, in case of which the signal receiver 29 and/or 33 repeats old signal contents. The individual interval lengths between the respective adjacent pulses are part of the signal contents, and the system has defined expectation of the dynamic change of the interval lengths in accordance with the specified pulse sequence. If the expectation is not in conformity with a measured interval length, faulty behavior of the system may be assumed. The interval length to be expected between two successive pulses, be it pulses of a pulse sequence without gaps or pulses of a pulse sequence with gaps, can be determined with the aid of the tables deposited in memory 51.

If there is interference occurring between regular pulses of a pulse sequence and partly reflected pulses, in which the reflections may be caused due to insufficient or faulty signal attenuation members at both ends of sound conductor 13 or by bends in a metal wire serving as sound conductor 13, a systematic measurement error occurs which affects only one of the pulses of the pulse sequence. The effect of such interference can be mitigated by filtering or may be observed for diagnostic purposes.

The measuring method according to the invention is less sensitive with respect to periodic noise signals than the conventional measuring methods.

The pulse sequence illustrated in FIG. 2 is designed for an elevator system having a travel path of the elevator car of 130 m. The period duration of the pulse sequence of 33 ms is greater than the maximum sound propagation time in a wire used as sound conductor 13, which is 29 ms in case of a length of 130 m. It is thus ensured that the association of the receiving signals with the transmission signals is unequivocal since there can never be two pulses with the same pulse identification number on the sound conductor wire.

In using the pulse sequence according to the invention to the invention, there is no synchronization pulse necessary. The function of the latter in conventional measuring methods, namely an association of the individual pulses (having the same pulse interval) with the respectively related transmission pulse is replaced in the case according to the invention in that each pulse of the respective pulse sequence can be identified unequivocally by way of its distance in time from the preceding pulse and that only pulses of one and the same pulse sequence can be present on the sound conductor at a particular time, since the pulse sequence period duration is greater than the sound propagation time between the two sound conductor ends.

The pulse sequence of the example illustrated in FIG. 2 is optimized in so far as, in case there are two pulses missing between any consecutive receiving pulses of the pulse sequence, the interval distances at the gap locations will vary in the range from 8.5 ms to 9.5 ms for all possible gap positions of the pulse sequence. Such a pulse interval is compatible with the operating cycle of software as it is usual for elevator systems with position detecting means making use of sound signal propagation time measuring means.

The pulse sequence according to the invention leads to the following advantages:

In comparison with a pulse sequence according to DE 1 903 645 A1, the pulse sequence according to the invention results in improved resistance against disturbances caused by interference of sound pulses with reflections of these sound pulses, which is achieved by the determination of different individual interval lengths between the consecutive pulses.

As compared to the position detecting method according to EP 0 694 792 605 A1, the position detecting method according to the invention provides for improved interference immunity as quantization errors and the like are averaged. In addition thereto, the position detecting method according to the invention, as compared to the known position detecting method, involves lesser follow-up times of the individual measuring operations due to the denser succession of measuring operations in time.

As compared to the position detecting method according to DE 199 036 45 A1, the position detecting method according to the invention provides for faster synchronization between receiving pulses and transmission pulses since it is not necessary to wait for the synchronization pulses first. The method according to the invention makes the measuring values available faster than in case of the known method.

The position detecting method according to the invention is suited better for safety applications in connection with elevator systems than the known position detecting methods, due to the well defined predictability for each pulse interval independently of the respective measured position value of the elevator car.

The measuring method according to the invention is less sensitive with respect to periodic noise signals. As compared to EP 0 694 792 A1, the method according to the invention provides for redundancy due to higher measurement rates. Results of irregular disturbances may be rejected without impairment to the position measurement.

Although the invention has been shown and described with respect to the exemplary embodiments, it should be understood by the skilled in the art that the foregoing and other changes, omissions and additions may be made thereto without departing from the spirit and scope of the invention.

We claim:

1. A position detecting device for detecting the position of an object (12) movable along a predetermined path of movement, comprising:

a signal transmission medium (13) extending along the path of movement;

a signal generator (15) movable together with said movable object (12), by means of which a signal can be coupled into the signal transmission medium (13) at a coupling location thereof changing in accordance with the movement of said signal generator (15); at least one signal receiver (29, 33) at an extraction location in an end portion of said path of movement, by means of which the signal can be extracted from the signal transmission medium (13);

a signal propagation time measuring means (35, 37) adapted to determine the signal propagation time between coupling location and extraction location by evaluating the signal extracted at the extraction location; and a processing means (45) adapted to derive from the signal propagation time ascertained a position signal indicating the instantaneous position of the object (12) along the path of movement;

wherein the signal generator (15) is designed to deliver a periodically repeating signal pulse sequence (FIG. 2) in which the time intervals between consecutive signal pulses are different for each pair of consecutive signal pulses, the period duration of the repetitive signal pulse sequence is greater than the maximum signal propagation time with maximum distance between coupling location and extraction location, and the time intervals between consecutive signal pulses are shorter than the maximum signal propagation time.

2. A position detecting device according to claim 1, wherein the signal is constituted by a sound signal, the signal transmission medium (13) is constituted by a sound conductor, the signal generator (15) is constituted by a sound signal generator, the signal receiver (29, 33) is constituted by a sound signal receiver, and the signal propagation time measuring means (35, 37) is constituted by a sound propagation time measuring means.

3. A position detecting device according to claim 2, wherein the sound signal generator comprises a signal generating means for generating electric pulses (41, 43) on the signal generator side, a signal transducer on the signal generator side for converting the electric pulses into sound pulses (23, 25), and a signal coupler for coupling the sound pulses into the sound conductor.

4. A position detecting device according to claim 3, wherein the sound signal receiver comprises a signal extractor for extracting the sound pulses (23, 25) from the sound conductor as well as a signal transducer on the receiver side for converting the sound pulses into electric pulses on the receiver side.

5. A position detecting device according to claim 4, wherein the sound propagation time measuring means is coupled both to the signal generator (15) and to the signal receiver (29, 33) on the receiver side and, for determining the signal propagation time, makes use both of the electric pulses (41, 43) on the signal generator side and of the electric pulses on the receiver side.

6. A position detecting device according to any of claims 5, wherein in the region of each one of the two end points (19, 21) of the path of movement, there is provided an extraction location having a signal receiver (29, 33) and a signal propagation time measuring means (35, 37), by means of which the signal propagation time between coupling location and the respective extraction location can be determined, and wherein the processing means (45) is designed to determine the instantaneous position of the movable object (12) from the signal propagation times ascertained.

7. A position detecting device according to claim 6, wherein the individual pulses of the signal pulse sequence (FIG. 2) each have an individual pulse identification number (1 to 11) assigned thereto, and the at least one signal receiver (29, 33) comprises a pulse identification number determining means (FIG. 3) for determining the identification number (1 to 11) of the respective signal pulse extracted at the extraction location, the pulse identification number determining means being designed to determine the time interval of the respective extracted signal pulse from the respective signal pulse extracted before and to assign to the respective extracted signal pulse a pulse identification number dependent on the distance in time ascertained.

8. A position detecting device according to claim 7, comprising a signal generator (15) providing ultrasonic signals.

9. A position detecting device according to claim 7, comprising an elevator car as movable object (12).

10. A position detecting device according to claim 7, comprising a sound conductor in the form of a metal rail.

11. A position detecting device according to claim 7, comprising a sound conductor in the form of a metal rope.

12. A position detecting device according to claim 7, comprising a sound conductor in the form of a metal wire.

* * * * *